US010458187B2

(12) United States Patent
Schroder

(10) Patent No.: US 10,458,187 B2
(45) Date of Patent: Oct. 29, 2019

(54) SEAL ASSEMBLIES FOR EARTH-BORING TOOLS, EARTH-BORING TOOLS SO EQUIPPED, AND RELATED METHODS

(71) Applicant: Baker Hughes, a GE company, LLC, Houston, TX (US)

(72) Inventor: Jon D. Schroder, The Woodlands, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 427 days.

(21) Appl. No.: 15/040,157

(22) Filed: Feb. 10, 2016

(65) Prior Publication Data

US 2016/0251903 A1 Sep. 1, 2016

Related U.S. Application Data

(60) Provisional application No. 62/126,047, filed on Feb. 27, 2015.

(51) Int. Cl.
*E21B 10/25* (2006.01)
*E21B 10/46* (2006.01)
*E21B 10/22* (2006.01)

(52) U.S. Cl.
CPC ..... *E21B 10/25* (2013.01); *E21B 10/46* (2013.01); *E21B 2010/225* (2013.01)

(58) Field of Classification Search
CPC ..... E21B 10/25; E21B 10/46; E21B 2010/225
See application file for complete search history.

(56) References Cited

U.S. PATENT DOCUMENTS 3,193,028 A 7/1965 Radzimovsky
4,516,641 A 5/1985 Burr
4,822,057 A * 4/1989 Chia ..... E21B 10/25 175/371
5,251,914 A * 10/1993 Tatum ..... E21B 10/25 175/371
6,684,966 B2 2/2004 Lin et al.
7,413,037 B2 8/2008 Lin et al.
(Continued)

OTHER PUBLICATIONS

International Search Report for International Application No. PCT/US2016/019799 dated Jun. 15, 2017, 3 pages.
(Continued)

*Primary Examiner* — Robert E Fuller
*Assistant Examiner* — Christopher J Sebesta
(74) *Attorney, Agent, or Firm* — TraskBritt

(57) ABSTRACT

An earth-boring tool includes a body and a rotating member disposed over a protrusion from the body and configured to rotate relative to the body. A bearing assembly may be disposed within a cavity of the rotating member. The bearing assembly may include an inner race coupled with the body and an outer race coupled with the rotating member. A bearing retainer may be affixed within the cavity of the rotating member and may retain the bearing assembly within the cavity of the rotating member. The earth-boring tool further includes a seal assembly including a sealing element rotationally coupled with the rotating member, the sealing element comprising a first sealing surface. A second sealing surface may be disposed on the inner race, and an energizing element urges the first sealing surface into sealing engagement with the second sealing surface.

20 Claims, 3 Drawing Sheets

(56) References Cited

U.S. PATENT DOCUMENTS

| | | | | |
|---|---|---|---|---|
| 2004/0031625 | A1* | 2/2004 | Lin | E21B 10/25 175/371 |
| 2005/0274550 | A1 | 12/2005 | Yu et al. | |
| 2006/0032673 | A1* | 2/2006 | Yong | E21B 10/25 175/372 |
| 2009/0173546 | A1 | 7/2009 | Peterson et al. | |
| 2009/0321146 | A1* | 12/2009 | Dick | E21B 10/22 175/371 |
| 2011/0024199 | A1* | 2/2011 | Zahradnik | E21B 10/25 175/412 |
| 2011/0187058 | A1* | 8/2011 | Curry | E21B 10/25 277/336 |
| 2014/0224548 | A1* | 8/2014 | Lebeck | E21B 10/25 175/371 |
| 2014/0224549 | A1 | 8/2014 | Lebeck | |
| 2014/0326514 | A1 | 11/2014 | Lin et al. | |

OTHER PUBLICATIONS

International Written Opinion for International Application No. PCT/US2016/019799 dated Jun. 15, 2017, 9 pages.
Chinese Notification of First Office Action Received for CN Application No. 201680012272.0, dated Sep. 30, 2018.
Canadian Office Action Received for CA Application No. 2,977,797, dated Jun. 20, 2018, 4 pages.
European Search Report and Search Opinion Received for EP Application No. 16756454, dated Oct. 8, 2018, 8 pages.
Canadian Office Action for Canadian Application No. 2,977,797 dated Jan. 25, 2019, 4 pages.
Chinese Second Office Action for Chinese Application No. 201680012272, dated Jun. 13, 2019, 12 pages with English Translation.

* cited by examiner

SEAL ASSEMBLIES FOR EARTH-BORING TOOLS, EARTH-BORING TOOLS SO EQUIPPED, AND RELATED METHODS

CROSS-REFERENCE TO RELATED APPLICATION

This application claims the benefit of U.S. Provisional Patent Application Ser. No. 62/126,047, filed Feb. 27, 2015, the disclosure of which is hereby incorporated herein in its entirety by this reference.

TECHNICAL FIELD

Embodiments of the present disclosure relate to earth-boring tools for drilling boreholes, and to seal assemblies utilized in such tools.

BACKGROUND

Earth-boring tools are used to form boreholes (e.g., wellbores) in subterranean formations. Some earth-boring tools, such as roller cone drill bits and hybrid drill bits, include a rotational bearing between a non-rotating member and a rotating member such as a roller cone including cutting elements. A bearing seal may protect the bearing by inhibiting the ingress of drilling fluid and formation cuttings to the bearing and by at least partially preventing discharge of lubricant (e.g., grease) used to lubricate both the bearing and the seal. One type of seal used in such tools employs primary metal-to-metal face seals that are energized by, for example, an elastomeric ring. Such a seal may be referred to as a rigid face seal or a metal face seal. Such seals may include at least one rigid ring having a seal face thereon, and an energizing element, which urges the seal face of the rigid ring into sealing engagement with a second sealing face. One or both of the sealing faces may be coated with a wear-resistant coating, such as diamond-like carbon (DLC). Embodiments of such bearing seals are disclosed in U.S. Pat. No. 7,413,037 to Lin et al., issued Aug. 19, 2008, and assigned to the assignee of the present disclosure (the '037 patent), which is hereby incorporated by reference for all it contains.

As disclosed in the '037 patent, the rigid ring may be confined in a groove near the base of the shaft on which the roller cone is rotatably affixed. The second sealing face may be disposed on a sealing element (e.g., a steel ring) pressed into a cavity of the roller cone, and the energizing element may be located adjacent the base of the shaft and circumferentially inward from the rigid ring. Such an arrangement may require a certain minimum axial length of the bearing and seal assembly. Furthermore, relative rotational movement between the energizing element and one or both of the rigid ring and the shaft may occur in the event that the rigid ring sticks to the sealing element in the roller cone, resulting in poor sealing and rapid degradation of the energizing element. Finally, if an inward force is applied to the roller cone (i.e., a force urging the cone radially inward toward a rotational axis of a body of the bit) the biasing force provided by the energizing element may be reduced, compromising the seal and allowing lubricant to leak from the seal and/or allowing drilling fluid and formation cuttings to contaminate the bearing.

BRIEF SUMMARY

In one embodiment, an earth-boring tool includes a body, a rotating member disposed over a protrusion from the body and configured to rotate relative to the body, and a bearing assembly disposed within a cavity of the rotating member. The bearing assembly comprises an inner race coupled with the protrusion and an outer race coupled with the rotating member. A bearing retainer is affixed within the cavity of the rotating member and retains the bearing assembly within the cavity of the rotating member. The earth-boring tool also includes a seal assembly including a sealing element rotationally coupled with the bearing retainer, the sealing element comprising a first sealing surface. A second sealing surface is disposed on the inner race, and an energizing element urges the first sealing surface into sealing engagement with the second sealing surface.

In another embodiment, a drill bit includes a bit body, at least one cone rotatably coupled to the bit body and configured to rotate relative to the bit body, and a sealing element disposed at least partially within a cavity of the at least one cone. The sealing element comprises a first sealing surface. A second sealing surface is affixed to the bit body and faces generally radially outward from an axis of rotation of the bit body. An energizing element urges the first sealing surface of the sealing element into sealing engagement with the second sealing surface.

In yet another embodiment, a method of assembling a drill bit includes inserting a bearing within a cavity of a roller cone, affixing a bearing retainer comprising a sealing element within the cavity of the roller cone, abutting the sealing element against an inner race of the bearing, and affixing the roller cone over a shaft protruding from a body of one of a roller-cone drill bit and a hybrid drill bit.

BRIEF DESCRIPTION OF THE SEVERAL VIEWS OF THE DRAWINGS

While the specification concludes with claims particularly pointing out and distinctly claiming what are regarded as embodiments of the disclosure, various features and advantages of disclosed embodiments may be more readily ascertained from the following description when read with reference to the accompanying drawings, in which:

DETAILED DESCRIPTION

The illustrations presented herein are not actual views of any particular material, earth-boring tool, or component thereof, but are merely idealized representations employed to describe embodiments of the present disclosure. Additionally, elements common between figures may retain the same numerical designation.

Embodiments of the disclosure include bearing seals configured to inhibit leakage of lubricant from and ingress of drilling fluid and formation cuttings to rotational bearings in earth-boring tools. In particular, embodiments of bearing seals of the disclosure minimize (e.g., reduce) axial space requirements of the seal, simplify manufacturing and assembly, and improve reliability of bearing seals as compared to conventional bearing seal designs, as discussed below.

Figure 1:
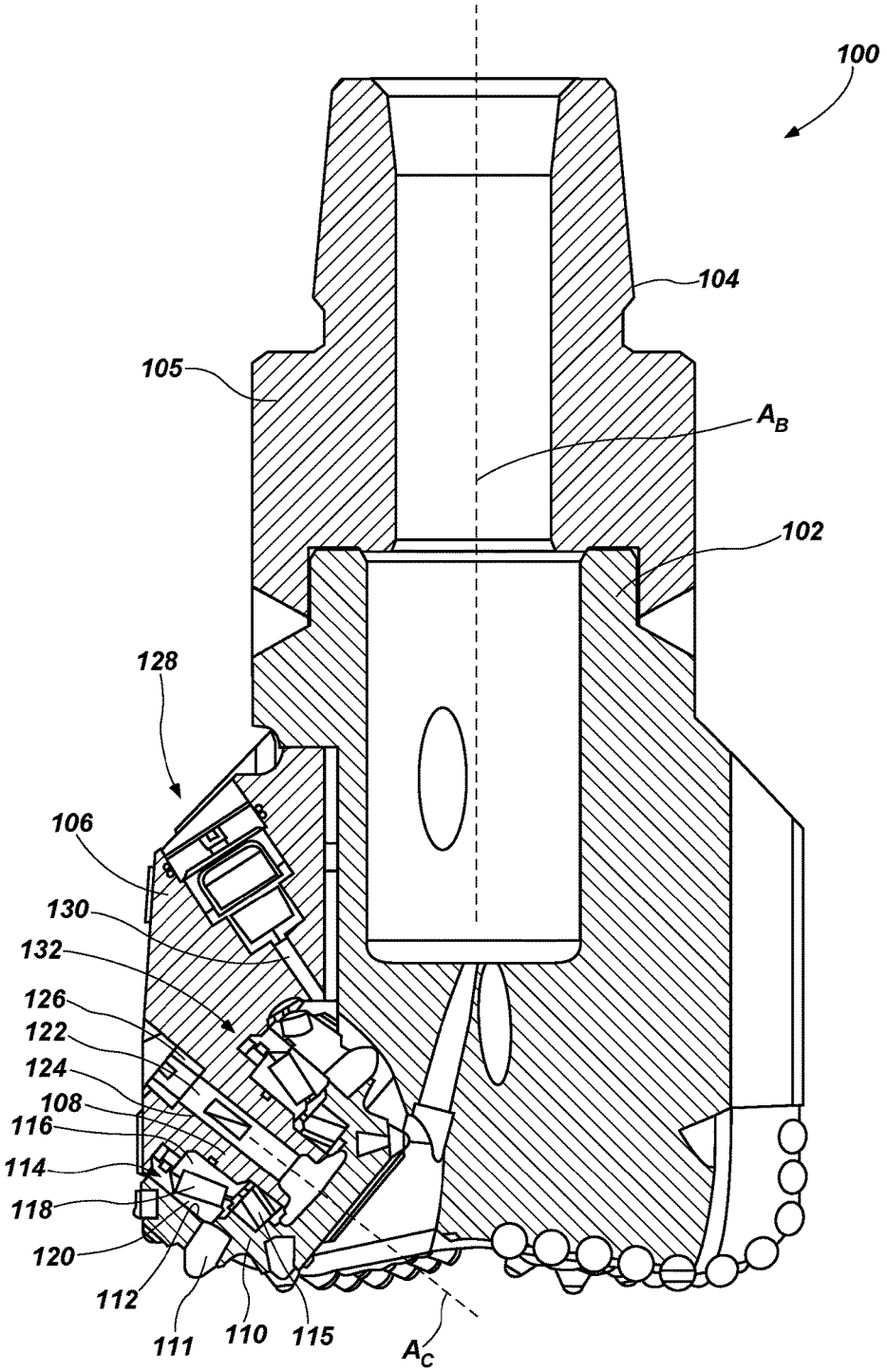
FIG. 1 is a cross-sectional view of an earth-boring tool according to an embodiment of the disclosure.

FIG. 1 shows a cross-sectional view of an embodiment of an earth-boring tool 100 according to the disclosure. The earth-boring tool 100 shown is a hybrid roller-cone/fixed cutter drill bit having a bit body 102, and includes a threaded pin connection 104 configured for connection to a box section at a distal end of a drilling assembly, (e.g., a drill string). In some embodiments, the bit body 102 is shown with a separate shank 105 carrying the threaded pin connection and affixed (e.g., welded) to the bit body 102. In other embodiments, the separate shank 105 and bit body 102 may be integral (i.e., a single unitary component). The bit body 102 includes a plurality of legs 106, each carrying a shaft 108 protruding radially inward from the corresponding leg 106 (i.e., depending generally toward a rotational axis $A_B$ of the bit body 102) at an acute included angle relative to rotational axis $A_B$. Each shaft 108 carries a respective cone 110, the shaft 108 being inserted within a cavity 112 of each respective cone 110. Each cone 110 includes a plurality of cutting elements, which are configured to grind and crush subterranean formation material under application of weight on bit. Such cutting elements may be disposed in complementary recesses in the surface of a cone 110 and are commonly characterized as "inserts" 111, comprising a material such as tungsten carbide, optionally having a portion or portions coated with, for example, a superabrasive material such as polycrystalline diamond or cubic boron nitride. Other materials having sufficient hardness and abrasion-resistance to remove material from a subterranean formation under applied weight on bit may be employed. In some embodiments, inserts 111 may comprise teeth formed as part of, and integral with, a cone 110. A bearing assembly 114 may be disposed between a surface of the cone 110 within the cavity 112 and the shaft 108.

As a non-limiting example, and as shown in FIG. 1, the bearing assembly 114 may be a tapered roller bearing including an inner bearing race 116, a plurality of rollers 118, and an outer bearing race 120. Each roller of the plurality of rollers 118 may be disposed between the inner bearing race 116 and the outer bearing race 120. Furthermore, each roller of the plurality of rollers 118 may be in contact with each of the inner bearing race 116 and the outer bearing race 120. The inner bearing race 116 may be configured for a non-interference fit (e.g., a slip fit) over the shaft 108, and the cone 110 and bearing assembly 114 may be retained on the shaft 108 by a tension rod 122 retained within a bore 124 of the shaft 108 by, for example, a threaded nut 126 engaged with the tension rod 122. In some embodiments, a secondary tapered roller bearing assembly 115 is disposed between the cone 110 and the shaft 108. In other embodiments, the bearing configuration may include one or more plain bearings (e.g., journal bearings) or other bearing configurations. For example, in some embodiments, the inner bearing race 116 may include a bearing journal, and the outer bearing race 120 may include a bearing surface configured to rotate against the journal of the inner bearing race 116.

A lubricant (e.g., grease) may be supplied to the bearing assembly 114 from a pressure-compensating lubrication system 128 through a lubricant passageway 130. A seal assembly 132 is disposed between a surface of the inner bearing race 116 and a surface of the cone 110 within the cavity 112, and prevents the flow of lubricant away from the bearing assembly 114. The seal assembly 132 also prevents ingress of drilling fluid and formation cuttings into the cavity 112 of the cone 110 to extend the life of the bearing assembly 114.

In use, the earth-boring tool 100 is advanced in a borehole by rotating a drill string, by rotating the earth-boring tool 100 with, for example, a mud motor of a bottom-hole assembly (BHA), or both. As the earth-boring tool 100 rotates and weight or other axial force is applied to the drill string, the cones 110 rotate on corresponding shafts 108 (i.e., rotate about a secondary rotational axis $A_C$) and inserts 111 engage and degrade the formation with a crushing and grinding action.

Figure 2:
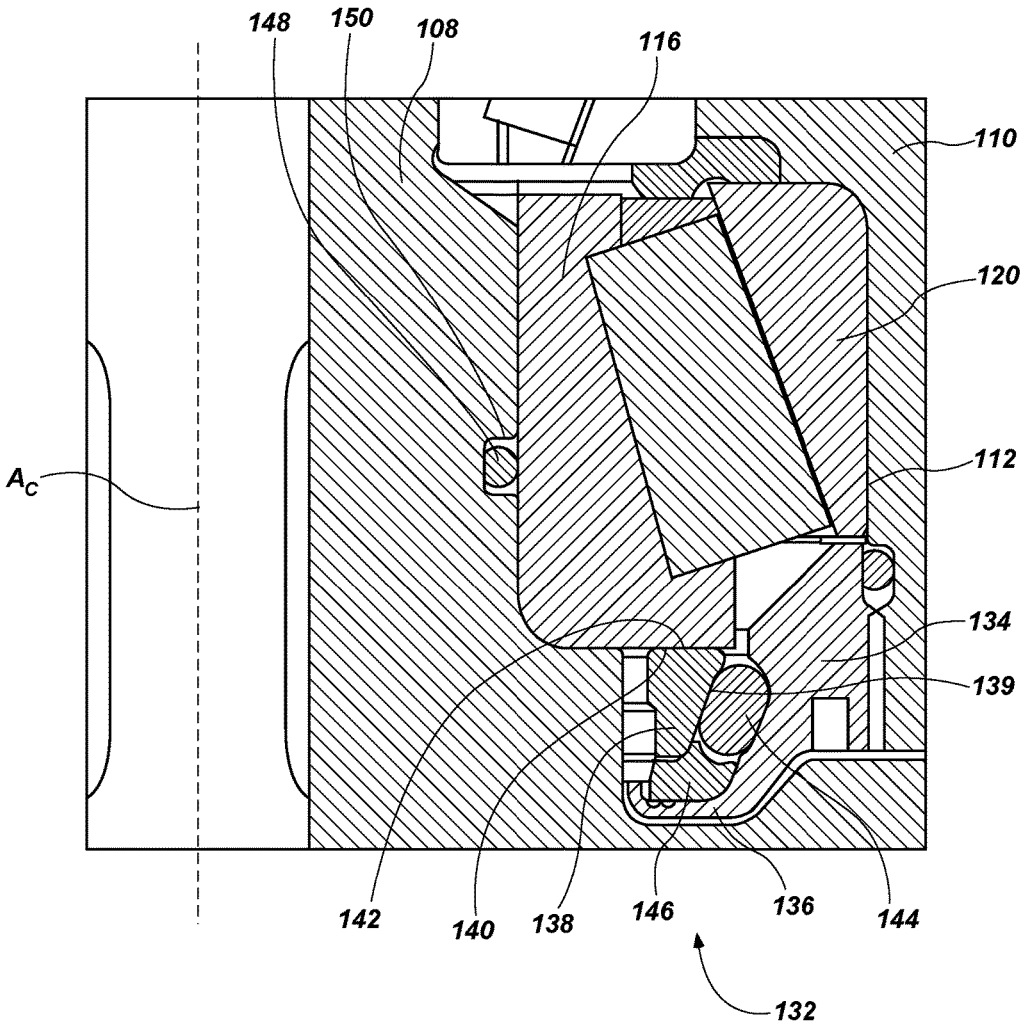
FIG. 2 is an enlarged cross-sectional view of a seal assembly of the earth-boring tool of FIG. 1.

Referring now to FIG. 2, an enlarged cross-sectional view of a seal assembly 132 of the disclosure is shown. In some embodiments, one or more components of the seal assembly 132 as described below may be at least partially disposed within a bearing retainer 134. The bearing retainer 134 may be threaded, pressed, brazed, or otherwise affixed within the cavity 112 of the cone 110. The bearing retainer 134 may abut at least a portion of the outer bearing race 120 to retain the outer bearing race 120 within the cavity 112 of the cone 110. In some embodiments, the bearing retainer 134 may include a flange 136 (i.e., an annular protrusion) configured to retain one or more components of the seal assembly 132 at least partially within the bearing retainer 134. The bearing retainer 134 and one or more components of the seal assembly 132 may be rotationally coupled with (i.e., rotate together with) the cone 110 about the secondary rotational axis Ac.

For example, a sealing element 138 may be rotationally coupled with the cone 110. In other words, the sealing element 138 may rotate with the cone 110 as the cone 110 rotates on the shaft 108 about the secondary rotational axis $A_C$. The sealing element 138 may comprise a metal alloy, such as steel, and may undergo thermal processing (e.g., heat treatment) to provide desired material characteristics such as a particular hardness value. In other embodiments, the sealing element 138 may comprise other metals, alloys, or non-metal materials (e.g., polymers). The sealing element 138 may have a substantially annular shape with a generally trapezoidal cross-section in a plane parallel with the rotational axis of the cone 110 and sealing element 138 (e.g., the cross-sectional plane of FIG. 2). The sealing element 138 may also be characterized as a "sealing ring." The sealing element 138 includes a first sealing surface 140. The first sealing surface 140 may be processed (e.g., ground, lapped, polished, etc.) to impart to the first sealing surface 140 a desired profile and surface finish.

The first sealing surface 140 may be in sealing engagement with a second sealing surface 142. In other words, contact between the first sealing surface 140 the second sealing surface 142 may impede intrusion of drilling fluid and/or formation cuttings between the first sealing surface 140 and the second sealing surface 142 and may prevent leakage of lubricant from the bearing assembly 114 (FIG. 1). The second sealing surface 142 may be disposed on a portion of the bit body 102 (FIG. 1), or may be disposed on a component affixed to the bit body 102. The second sealing surface 142 may remain stationary relative to the cone 110. In other words, the second sealing surface 142 may not rotate with the cone 110 as the cone 110 rotates about the secondary rotational axis $A_C$. For example, in some embodiments, the second sealing surface 142 may be disposed on a portion of the inner bearing race 116, and the inner bearing race 116 may be affixed to the shaft 108 of the bit body 102 (FIG. 1). The second sealing surface 142 may face generally radially outward with respect to the rotational axis $A_B$ (FIG. 1) of the bit body 102. In other words, the second sealing surface may be positioned inboard from an associated leg 106 (FIG. 1) of the bit body 102 and generally face the associated leg 106. The second sealing surface 142 may be processed (e.g., ground, lapped, polished, etc.) to impart to the second sealing surface 142 the desired profile and surface finish.

In some embodiments, one or both of the first sealing surface 140 and the second sealing surface 142 may comprise a wear-resistant coating. For example, one or both of the first sealing surface 140 and the second sealing surface 142 may comprise a coating of diamond-like carbon (DLC) material. In one exemplary embodiment, the second sealing surface 142 of the inner bearing race 116 may comprise a DLC coating, and the first sealing surface 140 may not include a surface coating. In other embodiments, one or both of the first sealing surface 140 and the second sealing surface 142 may include other wear resistant materials such as, for example, polycrystalline diamond material.

The seal assembly 132 may include an energizing element 144. The energizing element 144 may be said to "energize" the seal in the sense that the energizing element 144 provides a biasing force that urges the first sealing surface 140 of the sealing element 138 into sealing engagement with the second sealing surface 142 of the inner bearing race 116. For example, the energizing element 144 may comprise an elastomeric material compressed between the sealing element 138 and the bearing retainer 134. Furthermore, when compressed, the energizing element 144 may exhibit a compressive strain. As a non-limiting example, the energizing element 144 may be an O-ring comprising a nitrile material. The energizing element 144 may be substantially annular and have a circular, oval, elliptical, or other un-deformed cross-sectional shape. Compressing the energizing element 144 between the sealing element 138 and the bearing retainer 134 and causing the energizing element 144 to exhibit a compressive strain may create a biasing force urging the sealing element 138 into sealing engagement with the second sealing surface 142 of the inner bearing race 116 as the energizing element 144 attempts to return to an un-deformed configuration. For example, the energizing element 144 may have a substantially circular un-deformed cross-sectional shape, and compressing the energizing element 144 between the sealing element 138 and the bearing retainer 134 and causing the energizing element 144 to exhibit a compressive strain may impart to the energizing element 144 a substantially ovoid cross-sectional shape, as shown in FIG. 2.

The energizing element 144 may be located radially outward from the sealing element 138. For example, as shown in FIG. 2, the energizing element 144 may substantially circumferentially surround a generally frustoconical surface 139 of the sealing element 138 that faces generally radially outward from the sealing element 138 with respect to the secondary rotational axis $A_C$. Such an arrangement may provide advantages over some conventional seal arrangements. For example, in some conventional designs, an energizing element may be located radially inward from a sealing element, such that the contact area between the sealing face of the sealing element and a sealing surface on the cone occurs at a greater radial distance from the axis of rotation of the cone than does contact between the sealing element and the elastomeric energizing element. Accordingly, in such a conventional design, the contact area between the sealing element and the energizing element may be insufficient to prevent the sealing element from "sticking" to the sealing element in the cone (i.e., rotating with the cone) under certain conditions. If the sealing element begins to rotate with the cone, the seal between the sealing element and the sealing element in the cone may be compromised. Furthermore, relative rotational movement between the energizing element and the sealing element may quickly degrade the energizing element. In contrast, in some embodiments, the energizing element 144 may be positioned radially outward from the sealing element 138, increasing the contact area between the energizing element 144 and the sealing element 138, and preventing the sealing element 138 from "sticking" to the second sealing surface 142 of the inner bearing race 116.

In some embodiments, the seal assembly 132 may include a secondary seal element 146 disposed at least partially in the flange 136 of the bearing retainer 134. The secondary seal element 146 may comprise an elastomer or other material, and may have a shape configured to provide a seal between the flange 136 of the bearing retainer 134 and the sealing element 138 to prevent leakage of lubricant and ingress of drilling fluid and formation cuttings to the bearing assembly 114 (FIG. 1). A portion of the sealing element 138 opposite the first sealing surface 140 may abut the secondary seal element 146. The secondary seal element 146 may comprise, for example, an elastomeric material.

A static seal 148 may be disposed between a surface of the shaft 108 and the inner bearing race 116. In the embodiment shown in FIG. 2, the static seal 148 may be an O-ring disposed in a groove in the surface of the shaft 108. As the inner bearing race 116 may have a non-interference fit (e.g., a slip fit) over the shaft 108 to ease assembly, the static seal 148 may prevent intrusion of drilling fluid and formation cuttings between the inner bearing race 116 and the shaft 108 and eventual contamination of the bearing assembly 114. Similarly, the static seal 148 may prevent leakage of the lubricant from the bearing assembly 114.

Assembly of the seal assembly 132 may proceed as follows. The bearings 114, 115 (FIG. 1), and the tension rod 122 (FIG. 1) may be inserted within the cavity 112 of the cone 110. The sealing element 138, the energizing element 144, and the secondary seal element 146 may be placed within the flange 136 of the bearing retainer 134, and the bearing retainer may be affixed within (e.g., threadedly engaged with, pressed into, brazed within, etc.) the cavity 112 of the cone 110, so that the bearing retainer 134 abuts the outer bearing race 120 and the sealing element 138 is brought into sealing engagement with the inner bearing race 116, as described above. The tension rod 122 is then inserted within the bore 124 of the shaft 108, the inner bearing race 116 is guided over the shaft 108, and the nut 126 (FIG. 1) may be tightened over the tension rod 122 to retain the cone 110 over the shaft 108 and provide appropriate preload to the bearings 114 and 115.

In some embodiments, a seal assembly according to the disclosure may include a sealing element and an energizing element formed as a unitary component. For example, in some embodiments, the seal assembly may include a unitary component including both an energizing element and a sealing element. The unitary component may comprise, for example, a metal alloy. Such unitary energizing elements and sealing elements may be similar to the metallic seals disclosed in U.S. Patent App. Pub. No. 2014/0326514 A1 to Lin et al., published Nov. 6, 2014 and assigned to the assignee of the present disclosure, which is hereby incorporated by reference for all that it contains.

Figure 3:
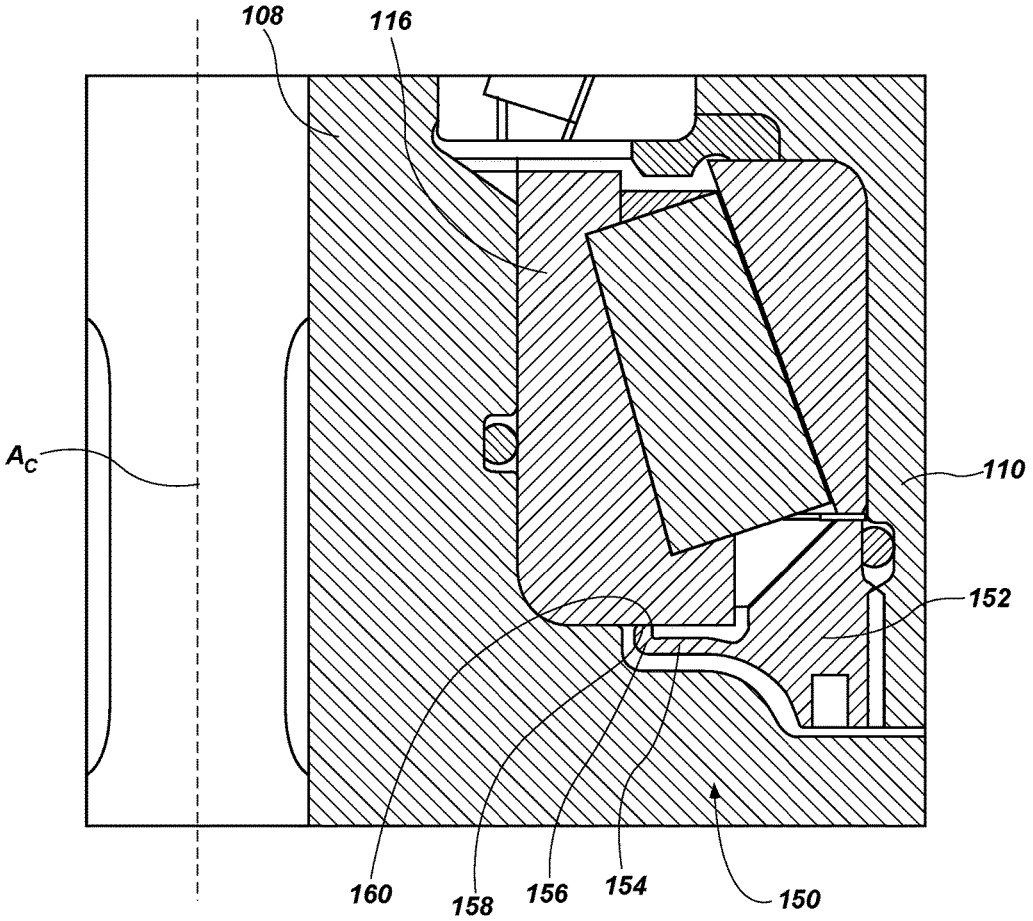
FIG. 3 is an enlarged cross-sectional view of an earth-boring tool with a seal assembly according to another embodiment of the disclosure.

Furthermore, in some embodiments, the unitary sealing element and energizing element may be formed integrally with a bearing retainer. For example, FIG. 3 shows a seal assembly 150 according to another embodiment of the disclosure. The seal assembly 150 may include an elastically deformable energizing element 154 depending radially inward from a bearing retainer 152 with respect to the secondary rotational axis $A_C$. The energizing element 154 may be formed integrally with the bearing retainer 152. A sealing element 156 may be formed integrally with the energizing element 154 and may depend radially inward from the energizing element 154 with respect to the secondary rotational axis $A_C$. The bearing retainer 152, the energizing element 154, and the sealing element 156 may comprise a metal alloy such as, for example, steel.

The sealing element 156 may include a first sealing surface 158 in sealing engagement with a second sealing surface 160 disposed on the inner bearing race 116. As described above in connection with FIG. 2, one or both of the first sealing surface 158 and the second sealing surface 160 may include a wear-resistant coating, for example, DLC, or other wear-resistant materials.

The energizing element 154 may be configured to provide a biasing force that urges the first sealing surface 158 of the sealing element 156 into sealing engagement with the second sealing surface 160 of the inner bearing race 116. For example, the energizing element 154 may be configured to elastically deform when the bearing retainer 152 is installed within the cone 110 and the first sealing surface 158 contacts the second sealing surface 160. Mechanical contact between the first sealing surface 158 and the second sealing surface 160 may prevent the energizing element 154 from returning to an un-deformed configuration, thus producing a biasing force urging the first sealing surface 158 into contact with the second sealing surface 160.

In some embodiments, the energizing element 154 and the sealing element 156 may be formed integrally, and may be affixed to a bearing retainer 152 formed separately from the integral energizing element 154 and sealing element 156. For example, the energizing element 154 and the sealing element 156 may be integrally formed and pressed or brazed within a seat (e.g., recess) formed in a separate bearing retainer. The integral energizing element 154 and sealing element 156 may comprise a metal alloy the same or different from a metal alloy of which the bearing retainer 152 is comprised.

Compared to some conventional seal designs, embodiments of bearing seals according to the disclosure may occupy less axial space in the cone, require fewer components and assembly steps, and exhibit improved reliability and sealing performance. For example, seal assemblies of the disclosure do not require a separate sealing element pressed into the cone, and accordingly occupy less axial space by comparison, enabling a reduction in the cutting diameter of the earth-boring tool 100. Furthermore, elimination of the separate sealing element pressed in the cone simplifies manufacturing and assembly of the earth-boring tool 100.

Moreover, locating the sealing element 138 (FIG. 2) or 156 (FIG. 3) and the energizing element 144 (FIG. 2) or 154 (FIG. 3) at least partially within the cone 110 and configuring the sealing element 138, 156 and energizing element 144, 154 to rotate with the cone 110 about the secondary rotational axis $A_C$ as described above may improve reliability of the seal compared to conventional seal designs in which the seal assembly is located on the shaft of the bit body and the sealing element does not rotate with the cone. For example, in such conventional designs, when a cone is subject to a force directed radially inward with respect to the bit body (in other words, a force tending to pull the cone away from an associated leg of the bit body and inward toward a rotational axis of the bit body), compressive strain exhibited by the energizing element 144 (FIG. 2) may be reduced and a biasing force generated by the energizing element 144 (FIG. 2) lessened accordingly. Under these conditions, the biasing force may be insufficient to maintain sealing engagement between the sealing element 138 and a sealing surface of the cone 110 (FIG. 2), allowing leakage of lubricant and ingress of drilling fluid and formation cuttings to the bearing. In contrast, in some embodiments, when the cone 110 (FIG. 2) is subject to a force directed radially inward toward the rotational axis $A_B$ (FIG. 1) of the bit body 102 (FIG. 1), contact between the sealing element 138 (FIG. 2) and the inner bearing race 116 (FIG. 2) urges the generally frustoconical surface 139 of the sealing element 138 against the energizing element 144 (FIG. 2), increasing the biasing force urging the sealing element 138 against the second sealing surface 142. Thus, embodiments of the disclosure maintain integrity of the seal even when such inward forces are applied to the cone 110.

Although the foregoing description and accompanying drawings contain many specifics, these are not to be construed as limiting the scope of the disclosure, but merely as describing certain embodiments. Similarly, other embodiments may be devised, which do not depart from the spirit or scope of the disclosure. For example, features described herein with reference to one embodiment also may be provided in others of the embodiments described herein. The scope of the invention is, therefore, indicated and limited only by the appended claims and their legal equivalents. All additions, deletions, and modifications to the disclosed embodiments, which fall within the meaning and scope of the claims, are encompassed by the present disclosure.

What is claimed is:

1. An earth-boring tool, comprising:

a body;

a rotating member disposed over a protrusion from the body and configured to rotate relative to the body;

a bearing assembly disposed within a cavity of the rotating member, the bearing assembly comprising:

an annular-shaped inner bearing race member coupled with the protrusion;

an annular-shaped outer bearing race member coupled with the rotating member; and at least one roller disposed between the inner bearing race member and the outer bearing race member, the at least one roller contacting each of the inner bearing race member and the outer bearing race member;

a bearing retainer affixed within the cavity of the rotating member and configured to retain the bearing assembly within the cavity of the rotating member; and a seal assembly comprising:

an annular sealing element rotationally coupled with the bearing retainer and defining a first sealing surface;

a second sealing surface defined by the inner bearing race member; and an energizing element disposed between the bearing retainer and the annular sealing element and creating a sealing engagement between the first sealing surface of the annular sealing element and the second sealing surface of the inner bearing race member.

2. The earth-boring tool of claim 1, wherein the bearing retainer comprises a flange, and wherein the annular sealing element is retained between the flange of the bearing retainer and the second sealing surface of the inner bearing race member when the bearing retainer is installed in the cavity of the rotating member.

3. The earth-boring tool of claim 2, wherein the energizing element is disposed radially outward from a portion of the annular sealing element and radially inward from a portion of the bearing retainer with respect to a rotational axis about which the rotating member rotates with respect to the body protrusion.

4. The earth-boring tool of claim 3, wherein the energizing element is compressed between a portion of the annular sealing element and a portion of the bearing retainer such that the energizing element exhibits a compressive strain when the bearing retainer is installed in the cavity of the rotating member.

5. The earth-boring tool of claim 4, wherein the energizing element produces a biasing force urging the first sealing surface of the annular sealing element into sealing engagement with the second sealing surface of the inner bearing race member when the energizing element is compressed between the bearing retainer and the annular sealing element.

6. The earth-boring tool of claim 2, further comprising a secondary annular seal element disposed between the flange of the bearing retainer and a portion of the annular sealing element opposite the first sealing surface.

7. The earth-boring tool of claim 6, wherein a portion of the annular sealing element opposite the first sealing surface abuts the secondary seal element.

8. The earth-boring tool of claim 1, wherein the annular sealing element and the energizing element are integral.

9. The earth-boring tool of claim 8, wherein the annular sealing element and the energizing element are formed from a metal alloy.

10. The earth-boring tool of claim 9, wherein elastic deformation of the energizing element produces a biasing force maintaining the first sealing surface of the annular sealing element in sealing engagement with the second sealing surface of the inner bearing race member when the bearing retainer is affixed within the cavity of the rotating member.

11. The earth-boring tool of claim 8, wherein the annular sealing element and energizing element are integral with the bearing retainer.

12. The earth-boring tool of claim 1, wherein at least one of the first sealing surface and the second sealing surface comprise a wear-resistant coating.

13. The earth-boring tool of claim 1, further comprising a plurality of rollers disposed between and contacting the inner bearing race member and the outer bearing race member.

14. The earth-boring tool of claim 1, wherein the earth-boring tool comprises a drill bit, the protrusion comprises a shaft protruding from a leg of a bit body, and the rotating member comprises a roller-cone carrying cutting elements.

15. The earth-boring tool of claim 1, wherein the bearing retainer extends between and contacts both of the rotating member and the protrusion.

16. The earth-boring tool of claim 1, wherein the energizing element is disposed radially outward from the annular sealing element.

17. A drill bit, comprising:

a bit body;

at least one cone rotatably coupled to the bit body and configured to rotate relative to the bit body;

a bearing assembly disposed within the at least one cone and between the at least one cone and the bit body, the bearing assembly comprising:

an annular-shaped inner bearing race member coupled with a protrusion;

an annular-shaped outer bearing race member coupled with a rotating member;

and at least one roller disposed between the inner bearing race member and the outer bearing race member, the at least one roller contacting each of the inner bearing race member and the outer bearing race member;

a bearing retainer affixed within the at least one cone and configured to retain the bearing assembly within the at least one cone;

an annular sealing element disposed at least partially within the at least one rotating cone and defining a first sealing surface;

a second sealing surface defined by the bearing assembly and facing generally radially outward from an axis of rotation of the bit body; and an energizing element disposed between the bearing retainer and the annular sealing element and creating a sealing engagement between the first sealing surface of the annular sealing element and the second sealing surface of the bearing assembly.

18. A method of assembling a drill bit, the method comprising:

inserting a bearing assembly within a cavity of a roller cone, the bearing assembly comprising:

an annular-shaped inner bearing race member coupled with a protrusion;

an annular-shaped outer bearing race member coupled with a rotating member; and at least one roller disposed between the inner bearing race member and the outer bearing race member, the at least one roller contacting each of the inner bearing race member and the outer bearing race member;

affixing a bearing retainer within the cavity of the roller cone;

disposing an seal assembly within the cavity of the roller cone; and affixing the roller cone over a shaft protruding from a body of one of a roller-cone drill bit and a hybrid drill bit, comprising:

rotationally coupling an annular sealing element of the sealing assembly to the bearing retainer, the annular sealing element defining a first sealing surface;

disposing an energizing element between the bearing retainer and the annular sealing element to create a sealing engagement between the first sealing surface of the annular sealing element and a second sealing surface of the inner bearing race member of the bearing assembly.

19. The method of claim 18, further comprising compressing the energizing element between the bearing retainer and the second sealing surface of the inner bearing race member of the bearing assembly such that the energizing element exhibits a compressive strain.

20. The method of claim 18, further comprising elastically deforming the energizing element comprising a metal alloy.

* * * * *